US007574970B2

(12) United States Patent
Fujihara

(10) Patent No.: US 7,574,970 B2
(45) Date of Patent: Aug. 18, 2009

(54) PRESSER FOR SEWING MACHINE AND SEWING MACHINE

(75) Inventor: Shinya Fujihara, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 12/078,039

(22) Filed: Mar. 26, 2008

(65) Prior Publication Data

US 2008/0236465 A1 Oct. 2, 2008

(30) Foreign Application Priority Data

Mar. 27, 2007 (JP) ..... 2007-081393

(51) Int. Cl.
*D05B 29/08* (2006.01)
*D05B 29/12* (2006.01)

(52) U.S. Cl. ..... 112/237

(58) Field of Classification Search ..... 112/235–240
See application file for complete search history.

(56) References Cited

U.S. PATENT DOCUMENTS 3,734,041 A * 5/1973 Robert ..... 112/320
4,580,516 A * 4/1986 Dreier ..... 112/311
5,097,778 A * 3/1992 Niino ..... 112/311
7,409,918 B2 * 8/2008 Fujihara et al. ..... 112/320

FOREIGN PATENT DOCUMENTS

| | | |
|---|---|---|
| JP | U 53-10643 | 1/1978 |
| JP | U 54-113654 | 8/1979 |
| JP | U 54-113655 | 8/1979 |
| JP | U 56-11774 | 1/1981 |
| JP | U 59-64989 | 4/1984 |

* cited by examiner

*Primary Examiner*—Ismael Izaguirre
(74) *Attorney, Agent, or Firm*—Oliff & Berridge, PLC

(57) ABSTRACT

A presser device for a sewing machine includes a first lever having a cloth pressing portion which is swingably mounted on a presser foot, the cloth pressing portion being swung so as to be switchable between a cloth pressing position and a raised position, a second lever having a support portion where the second lever is pivotally supported on an upper part of the first lever and an abutment which is normally in abutment with a needlebar assembly moved up and down, a first biasing member which biases the first lever so that the first lever is caused to pivot in such a direction that the cloth pressing portion becomes a cloth pressing position, and a second biasing member which biases the second lever so that the second lever is caused to pivot in such a direction that the abutment of the second lever is abutted against the needlebar assembly.

10 Claims, 18 Drawing Sheets

PRESSER FOR SEWING MACHINE AND SEWING MACHINE

CROSS-REFERENCE TO RELATED APPLICATIONS

This application is based on and claims the benefit of priority from the prior Japanese Patent Application No. 2007-81393, filed on Mar. 27, 2007, the entire contents of which are incorporated herein by reference.

BACKGROUND

1. Field

The present invention relates to a sewing machine, and more particularly to a presser device therefor including presser feet pressing a workpiece cloth.

2. Related Art

Various intermittent presser devices have conventionally been proposed which intermittently presses a workpiece cloth in time with needle drop during sewing. The intermittent presser devices are detachably attached to a lower end of a presser bar. Since the workpiece cloth is reliably pressed thereby to be held by the intermittent presser device during the forming of a needle thread loop, a normal needle thread loop can be formed and accordingly, defective sewing due to skip stitch can be prevented.

One of the conventional intermittent presser devices includes a cloth presser body having a needle clamp abutment and a cloth pressing portion formed integrally with a lower end of the cloth presser body. The cloth presser body is biased by a biasing member in such a direction that the cloth pressing portion serves as a cloth pressing location. When a needlebar is moved upward, a needle clamp abutment is pushed upward by a needle clamp, whereby the cloth pressing portion is raised from the cloth pressing location.

For example, JP-U-S54-113655 discloses a presser device for use with zigzag stitches comprising a zigzag stitch presser foot pressing cloth, a support mounted on a lower end of a presser bar, a cloth presser arm having an end formed with a needle passing through hole, and an actuating lever secured integrally to the cloth presser arm. The actuating lever is pivotally mounted on a connecting pin of the support so as to be swingable. The actuating lever is biased by a spring mounted on the connecting pin in such a direction that a cam member of the actuating lever normally engages a horizontal pin (corresponding to a needle clamp) mounted on the needlebar.

The above-described presser device for zigzag stitches has a problem that the needle clamp collides against the actuating lever every time the needlebar is moved upward, thereby producing a collision noise. Furthermore, there is a problem that the collision noise becomes loud with increase in a sewing speed of the sewing machine.

Additionally, since a connecting pin on which the actuating lever is swingably mounted is located away from a needle location of the needle, the size of the support is increased and accordingly, the length of the actuating lever is also increased. As a result, there is a problem that it is difficult to reduce the size of the presser device.

SUMMARY

Therefore, an object of the present disclosure is to provide an intermittent presser device for a sewing machine which can prevent collision noise due to collision of the needle clamp against the actuating lever in the case where the needlebar is moved up and down during sewing and which has a reduced size.

The present disclosure provides a presser device for a sewing machine which includes a presser bar, a needle and a needlebar assembly, the presser device comprising a presser foot assembly which is connected to a lower end of the presser bar to press workpiece cloth to be sewn, a first lever having a cloth pressing portion which is swingably mounted on the presser foot, the cloth pressing portion being swung so as to be switchable between a cloth pressing position where a part of the workpiece cloth located near a needle location of the needle is pressed by the cloth pressing portion when the needle is moved downward and a raised position to which the cloth pressing portion is raised from the cloth pressing position, a second lever having a support portion where the second lever is pivotally supported on an upper part of the first lever and an abutment portion which is normally in abutment with the needlebar assembly moved up and down, a first biasing member which biases the first lever so that the first lever is caused to pivot in such a direction that the cloth pressing portion becomes a cloth pressing position, and a second biasing member which biases the second lever so that the second lever is caused to pivot in such a direction that the abutment portion of the second lever abuts against the needlebar assembly.

When the needle is moved downward, the second lever is swung with downward movement of the needlebar assembly, and the workpiece cloth located near the needle location is pressed by the cloth pressing portion of the cloth pressing member with the swinging of the first lever. Furthermore, when the needle is moved upward, the second lever is swung with the upward movement of the needlebar assembly, and the first lever is swung such that the cloth pressing portion is moved upward from the cloth pressing position thereby to be switched to the raised position. Accordingly, the workpiece cloth can reliably be pressed when the needle is moved downward. Since the second lever is normally in abutment with the needlebar assembly moved up and down, production of collision noise can be prevented between the second lever and the needlebar assembly.

The invention further provides a sewing machine comprising a presser bar, a needle, a needlebar assembly, a presser foot which is connected to a lower end of the presser bar to press workpiece cloth to be sewn, a first lever having a cloth pressing portion which is swingably mounted on the presser foot, the cloth pressing portion being swung so as to be switchable between a cloth pressing position where a part of the workpiece cloth located near the needle location of the needle is pressed by the cloth pressing portion when the needle is moved downward and a raised position to which the cloth pressing portion is raised from the cloth pressing position, a second lever having a support portion where the second lever is pivotally supported on an upper part of the first lever and an abutment which is normally in abutment with the needlebar assembly moved up and down, a first biasing member which biases the first lever so that the first lever is caused to pivot in such a direction that the cloth pressing portion becomes a cloth pressing position, and a second biasing member which biases the second lever so that the second lever is caused to pivot in such a direction that the abutment of the second lever is abutted against the needlebar assembly.

Since the sewing machine is provided with the above-described presser device, production of collision noise can be prevented between the second lever and the needlebar assembly. Furthermore, since the workpiece cloth located near the needle location is intermittently pressed by the cloth pressing portion during sewing, defective sewing due to skip stitch can be prevented.

BRIEF DESCRIPTION OF THE DRAWINGS

Other objects, features and advantages of the present disclosure will become clear upon reviewing the following description of embodiments with reference to the accompanying drawings, in which.

DETAILED DESCRIPTION

Figure 1:
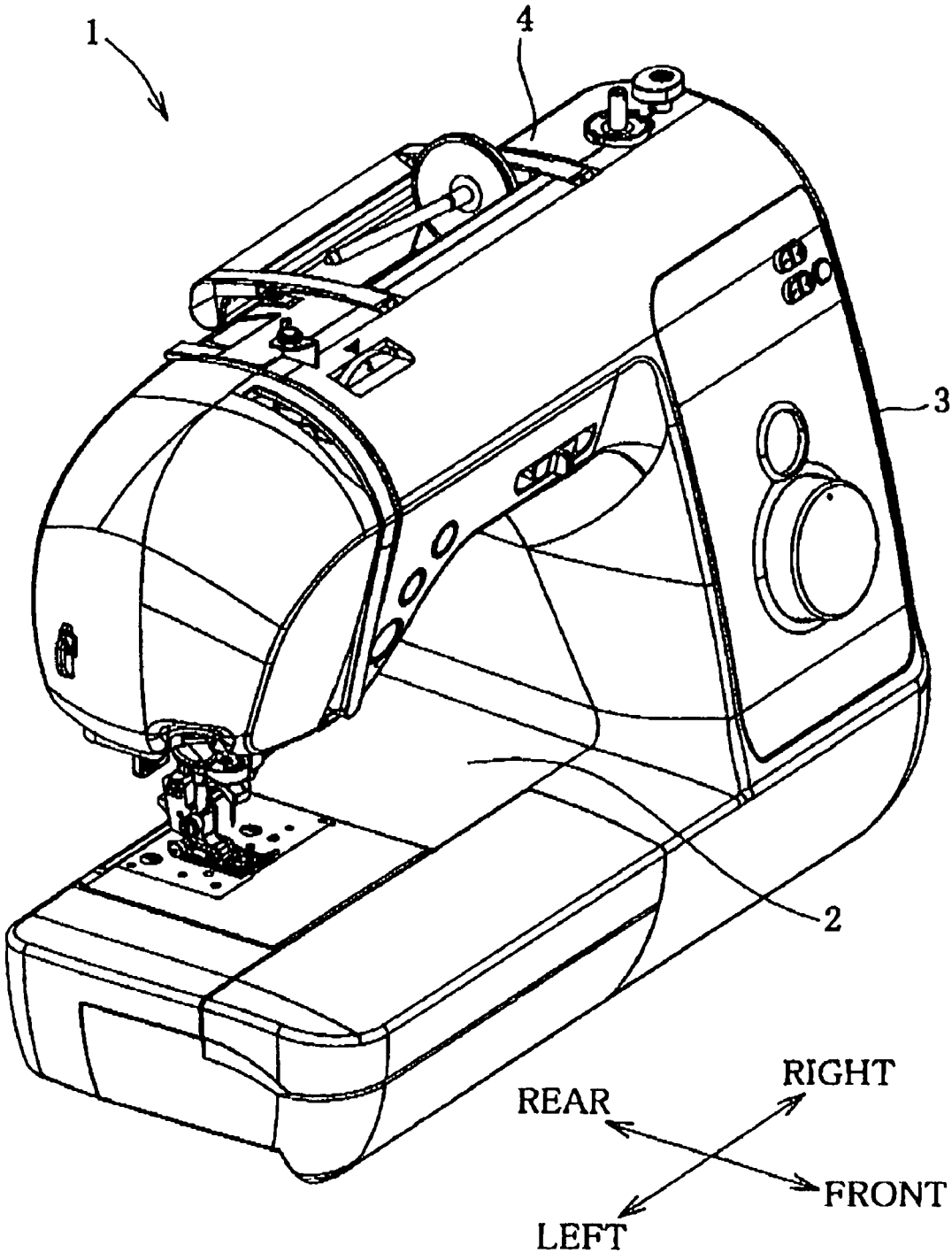
FIG. 1 is a perspective view of a sewing machine in accordance with one example.
Figure 2:
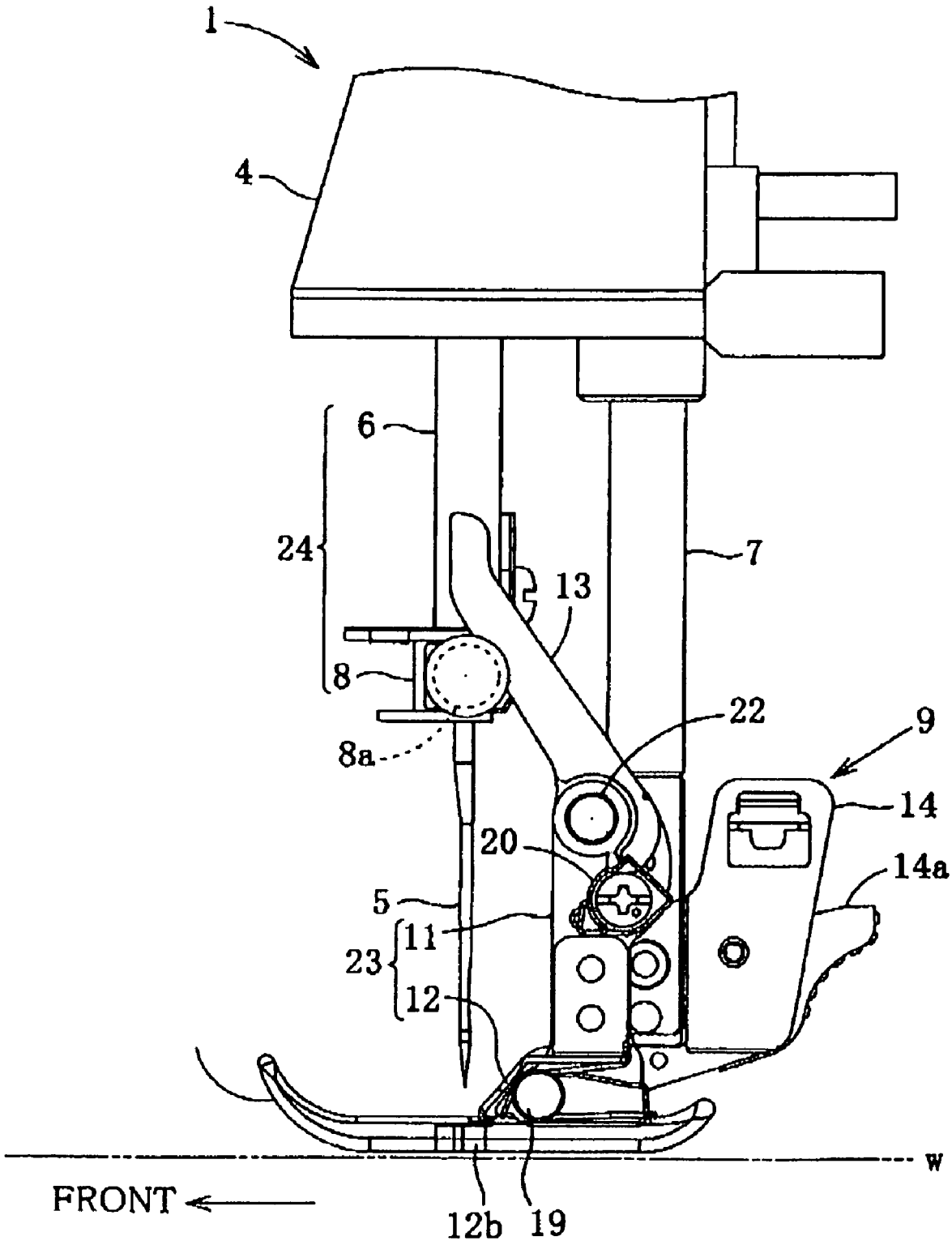
FIG. 2 is a right side view of the sewing machine to which a presser device in accordance with one example.
Figure 3:
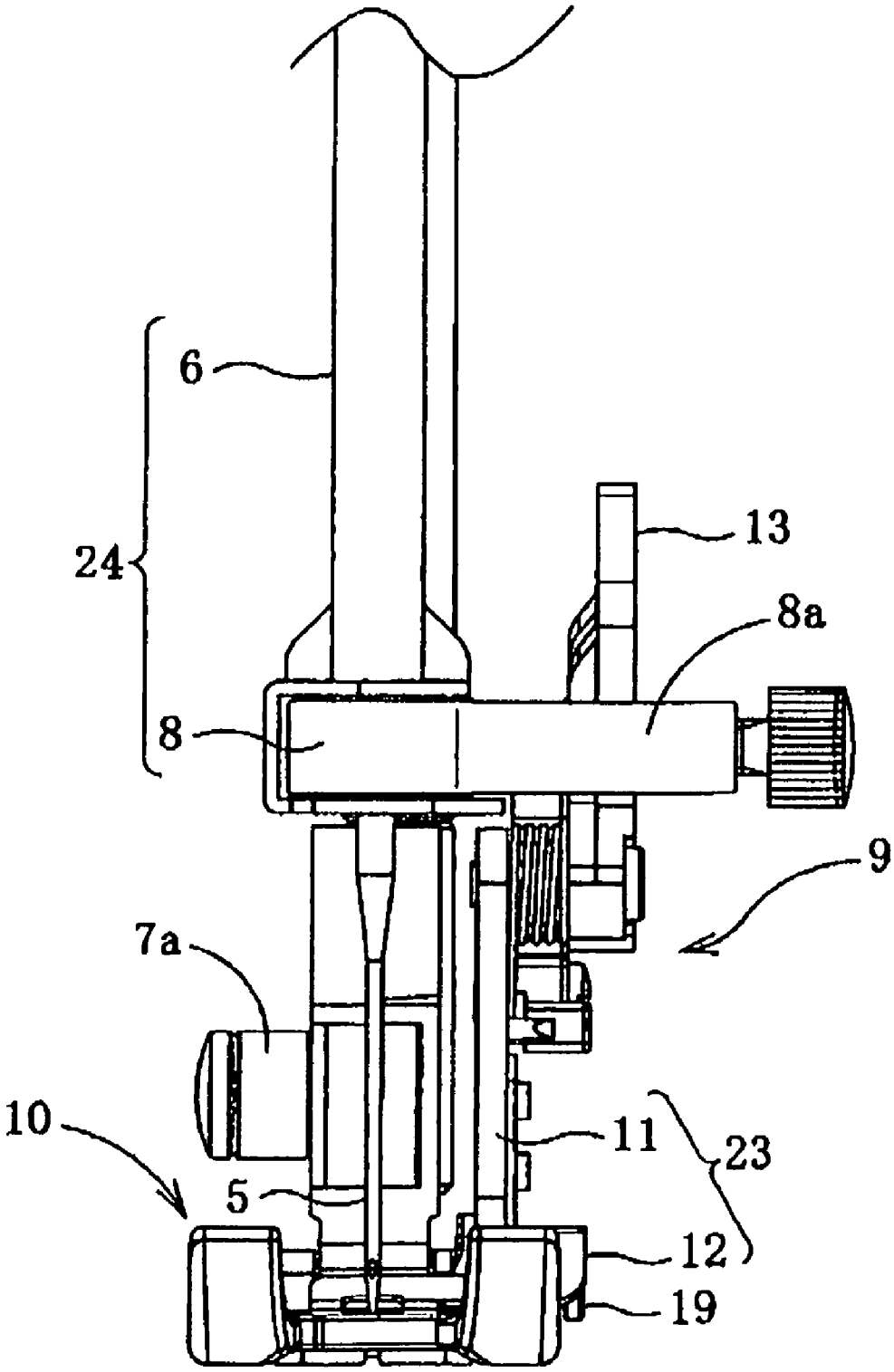
FIG. 3 is a front view of the sewing machine to which the presser device is attached.

One embodiment will be described with reference to the accompanying drawings. Referring to FIG. 1, a sewing machine 1 of the embodiment is shown. The sewing machine 1 is a zigzag sewing machine and includes a bed 2, a pillar 3 standing from an end of the bed 2, and an arm 4 extending from an upper end of the pillar 3 so as to be opposed to the bed 2. The arm 4 includes a needlebar drive mechanism (not shown) vertically moving a needlebar 6 having an end to which a needle 5 is attached, a needle swing mechanism (not shown) swinging the needlebar 6 in the longitudinal direction intersecting a cloth feed direction and an elevating mechanism (not shown) moving a presser bar 7 upward and downward between a raised position and a lowered position by a stepping motor (not shown) fixed to a sewing machine frame. The presser bar 7 is mounted on the sewing machine frame so as to be moveable upward and downward, as shown in FIG. 2. A needle clamp 8 is fixed to a lower end of the needlebar 6 constitutes a needlebar assembly 24 together with the needlebar 6. The needle 5 is fixed to the needlebar 6 by the needle clamp 8. On the other hand, a presser device 9 is mounted on a lower end of the presser bar 7. The presser device 9 includes a presser foot 10 pressing workpiece cloth W when sewing is carried out.

Figure 7:
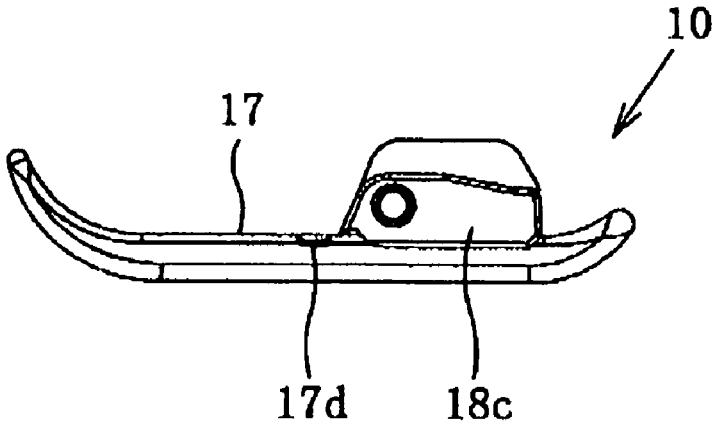
FIG. 7 is a right side view of a presser foot.
Figure 8:
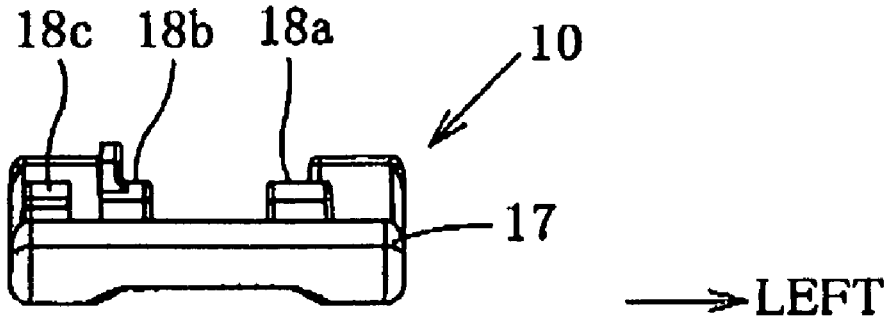
FIG. 8 is a rear view of the presser foot.

Referring now to FIGS. 2 to 6, the presser device 9 includes the presser foot 10 pressing the workpiece cloth W, a first lever member 11 swingably mounted on the presser foot 10, a cloth pressing member 12 mounted on the first lever 11 and constituting a first lever assembly 25 together with the first lever 11, a second lever member 13 abutting against the needle clamp 8 moved upward and downward with the needlebar 6, a presser holder 14, a first limiting mechanism 15 and a second limiting mechanism 16. The presser foot 10 comprises a metal member and includes a body 17, a pair of first connecting protrusions 18*a* and 18*b* which are disposed side by side on an upper surface of the body 17 so as to be spaced away from each other in the longitudinal direction and a second connecting protrusion 18*c*, as shown in FIGS. 7 and 8. The body 17 has a front end curved obliquely upwardly forward and a rear end curved obliquely upwardly rearward as shown in FIG. 7. Furthermore, the body 17 includes a bottom having right and left ends pressing the workpiece cloth W and a part which is located between the right and left ends and is recessed upward for prevention of stitch jamming as shown in FIG. 8.

Figure 9:
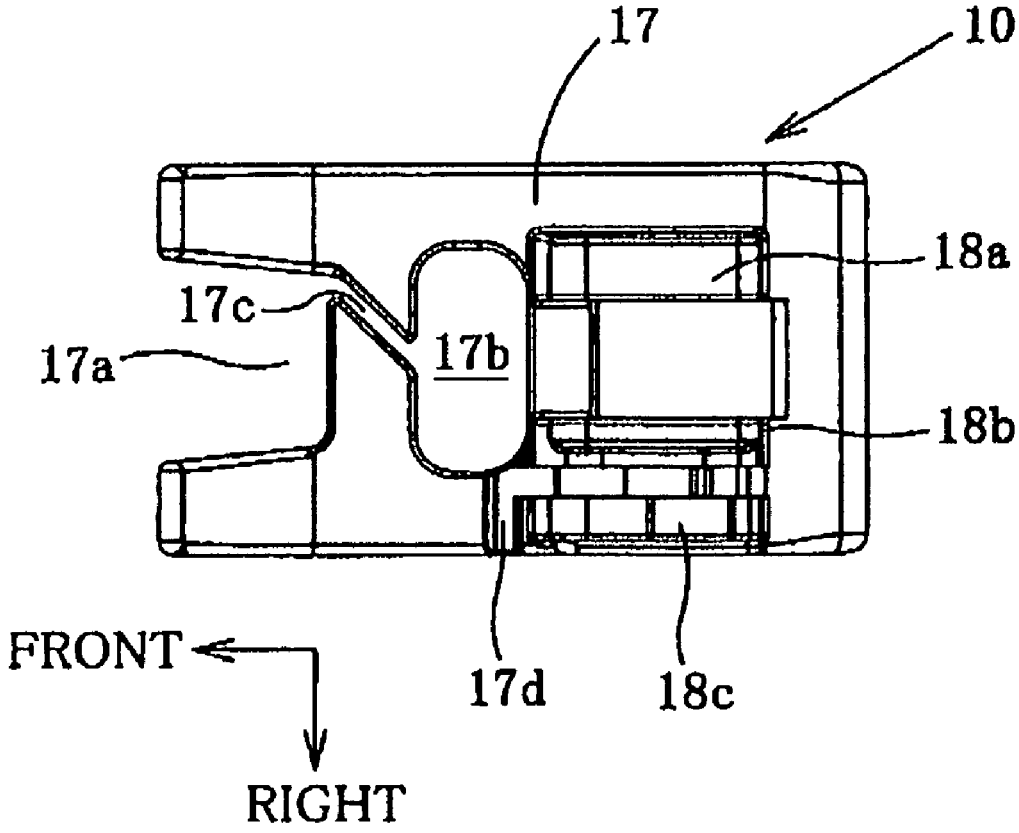
FIG. 9 is a plan view of the presser foot.

The body 17 has a front formed into a bifurcated shape and a notch 17*a* formed in a central part of the front as shown in FIG. 9. The body 17 further has an oval aperture 17*b* which can accommodate the cloth pressing portion 12*b* of the cloth pressing member 12, and a thread groove 17*c* connecting between the aperture 17*b* and the notch 17*a*. A pair of first connecting protrusions 18*a* and 18*b* are provided in the rear of right and left ends of the aperture 17*b*. The first connecting protrusions 18*a* and 18*b* are formed so as to protrude upward from the upper surface of the body 17. Each of the connecting protrusions 18*a* and 18*b* extends rearward and is formed into a rectangular shape. The second connecting protrusion 18*c* has substantially the same shape and size as the first connecting protrusions 18*a* and 18*b*. The second connecting protrusion 18*c* is spaced away rightward from the first connecting protrusion 18*b* and is parallel to the first connecting protrusion 18*b*. A groove 17*d* is provided in front of the second connecting protrusion 18*c* as shown in FIGS. 7 and 9. The groove 17*d* is provided in order to avoid interference between the second connecting protrusion 18*c* and an inclined portion 12*e* of the cloth pressing member 12.

Figure 4:
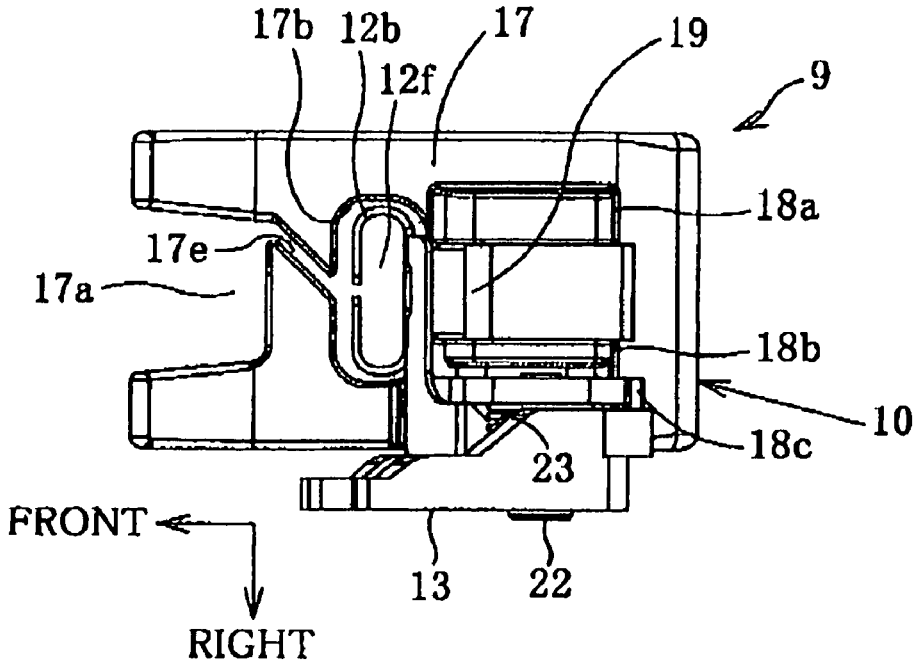
FIG. 4 is a plan view of the presser device.
Figure 5:
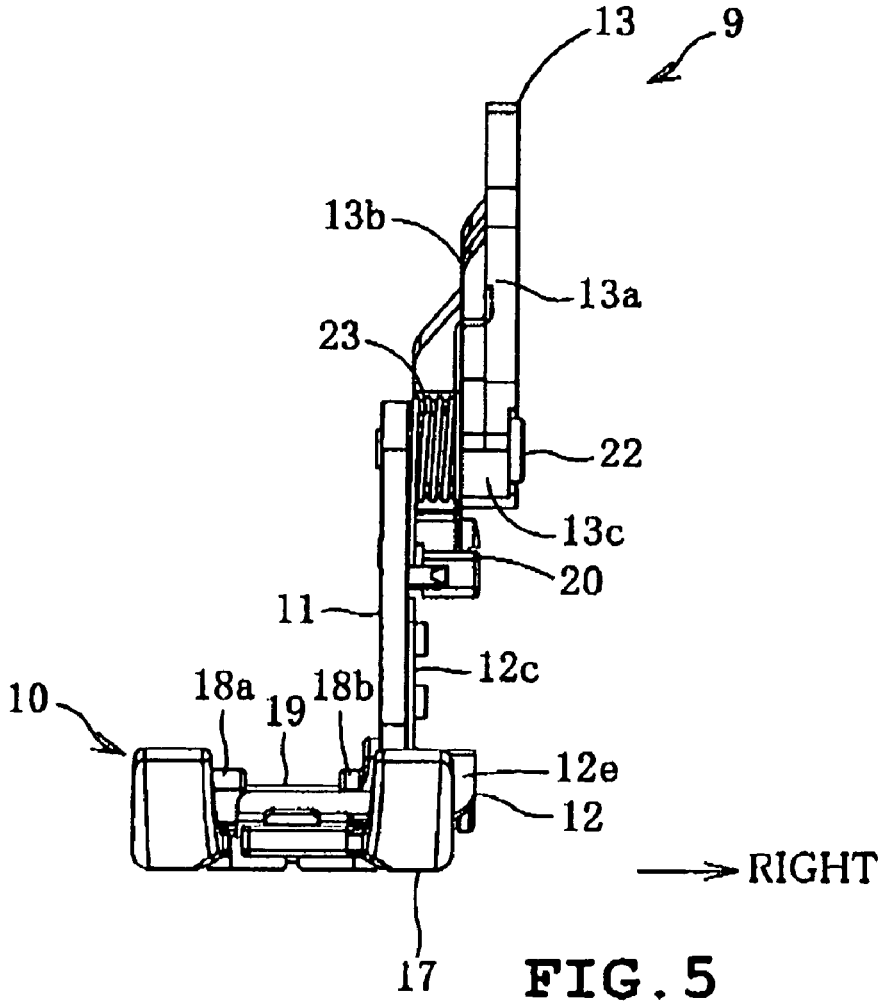
FIG. 5 is a front view of the presser device.
Figure 6:
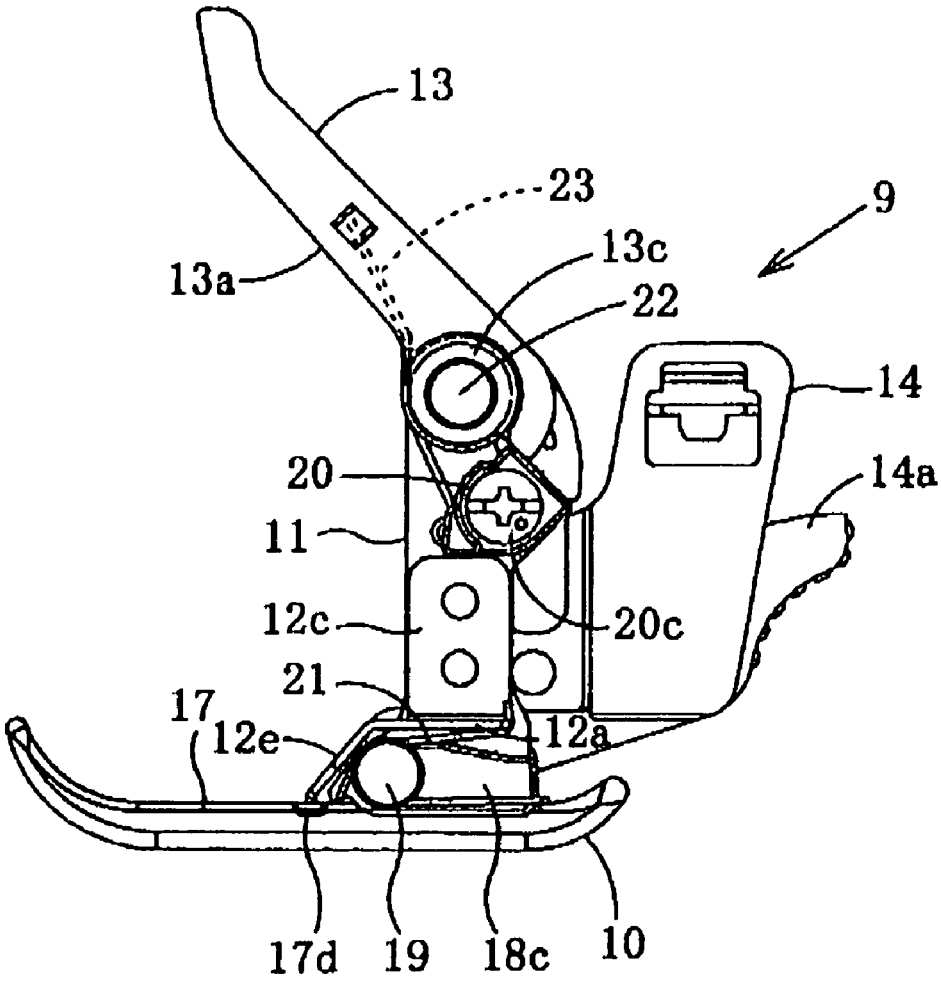
FIG. 6 is a right side view of the presser device.
Figure 10:
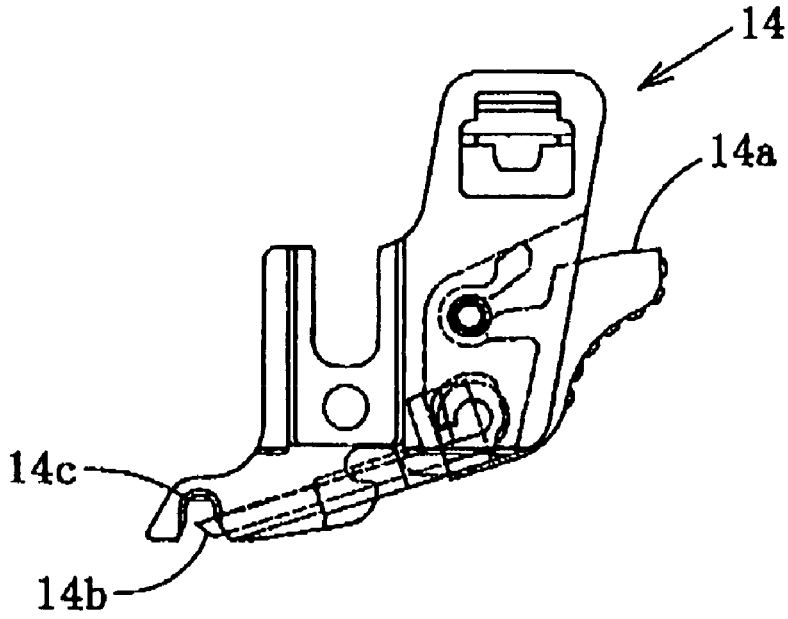
FIG. 10 is a right side view of a pressing holder.

A fixing pin 19 extends through the first connecting protrusions 18*a* and 18*b* and the second connecting protrusion 18*c* and is secured in position as shown in FIGS. 4 to 6. The pressing holder 14 has a lower end which is inserted into a gap between the first connecting protrusions 18*a* and 18*b* so as to be vertically directed relative to an upper surface of the body 17. The pressing holder 14 is detachably attached to the lower end of the presser bar 7 by a screw 7*a*. The pressing holder 14 has a lever portion 14*a* and an engagement portion 14*b* formed integrally with the lever portion 14*a* as shown in FIG. 10. The engagement portion 14*b* is located at a position which is outside the holder groove 14*c* which is further located in a lower distal end of the pressing holder 14. The lever portion 14*a* is made of an elastically deformable synthetic resin. The lever portion 14*a* is elastically deformed so as to rise from and set into the holder groove 14*c* of the pressing holder 14. When the fixing pin 19 secured to the body 17 is to be engaged with the pressing holder 14, the holder groove 14*c* of the pressing holder 14 and the fixing pin 19 are aligned with the fixing pin 19 and the pressing holder 14 is then moved downward, whereupon the fixing pin 19 is engaged with the body 17. On the other hand, when the fixing pin 19 is disengaged from the body 17, the lever portion 14*a* is pressed so that the engagement portion 14*b* retreated from the holder groove 14*c*, whereby the fixing pin 19 is disengaged from the pressing holder 14.

The lower end of the first lever member 11 is inserted into a gap between the first and second connecting protrusions 18*b* and 18*c*, whereby the first lever member 11 is mounted on the fixing pin 19 so as to be swingable in the front-back direction. The fixing pin 19 is located so as to be spaced away from a needle location of the needle 2. Furthermore, as shown in FIG. 11, on the upper surface (a surface opposed to the lower end of the first lever member 11) of the body 17 between the first and second connecting protrusions 18*b* and 18*c* are formed an inclined portion 17*e* which is formed in a front portion so as to be inclined slightly downwardly forward from the upper surface of the body 17, a curved groove 17*f* which is formed in a middle portion (right below the fixing pin 19) so as to be curved downward from the upper surface, and a protruding portion 17*g* which is formed on the rear portion so as to protrude upward.

Figure 11:
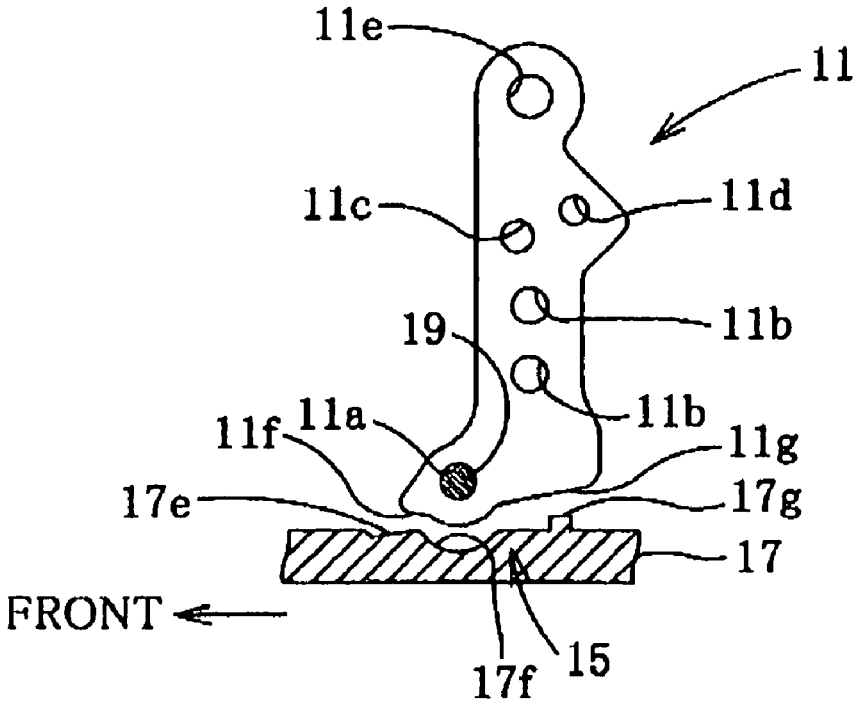
FIG. 11 is a right side view of a first lever.
Figure 12:
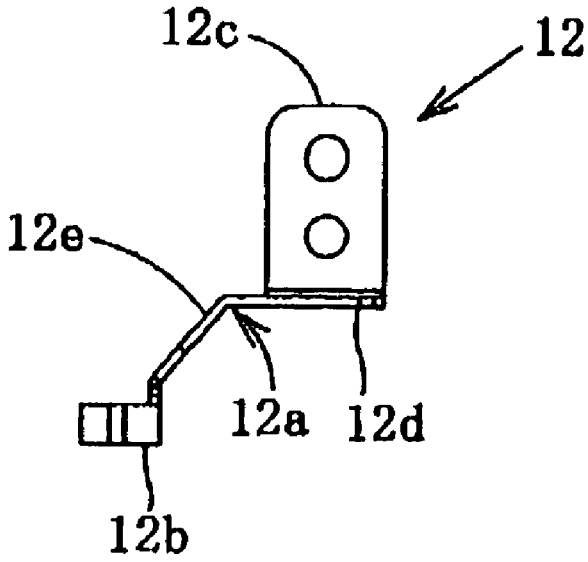
FIG. 12 is a right side view of a cloth pressing member.

Referring to FIGS. 5, 6 and 11, the first lever member 11 is a vertically long metal plate member as viewed at one side thereof and has a plurality of connecting apertures 11*a* to 11*e* vertically spaced from each other in a side thereof. A cloth pressing member 12 is mounted to a middle portion of the first lever 11. The cloth pressing member 12 is fixed to the first lever member 11 by two rivets inserted into the connecting apertures 11*b*. Furthermore, a stopper member 20 is mounted on the first lever member 11 by a fastening screw 20*c* screwed into the connecting aperture 11*d*.

Referring now to FIGS. 5, 6, 12 and 13, the cloth pressing member 12 comprises a thin leaf spring steel and includes an arm 12*a* and a cloth pressing portion 12*b* formed integrally on a lower end of the arm 12*a*. The arm 12*a* includes a connecting portion 12*c*, a horizontal portion 12*d* and an inclined portion 12*e*. The connecting portion 12*c* secured to a middle right side of the first lever member 11. A notch 12*g* is formed in the central rear end of the horizontal portion 12*d*. One of two ends of a torsion coil spring 21 (serving as a first biasing member) engages a right end of the fixing pin 19 as shown in FIG. 6. The other end of the torsion coil spring 21 engages a rear end of the second connecting protrusion 18*c*. The first lever member 11 is biased by a pivotal biasing force of the torsion coil spring 21 to such a direction that the cloth pressing portion 12*b* of the cloth pressing member 12 becomes a cloth pressing position of the workpiece cloth W.

Figure 13:
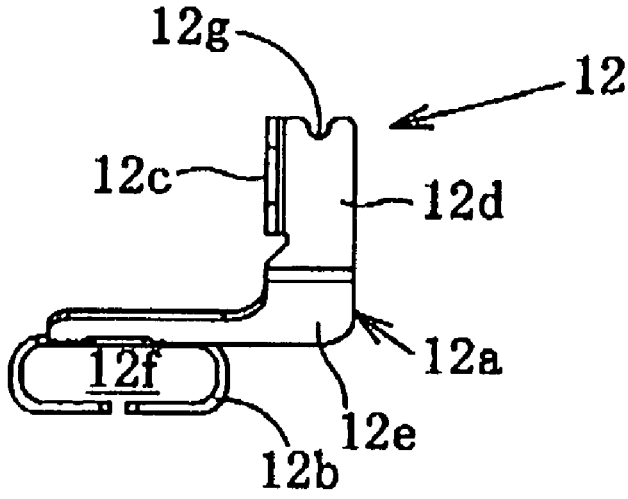
FIG. 13 is a plan view of the cloth pressing member.
Figure 14:
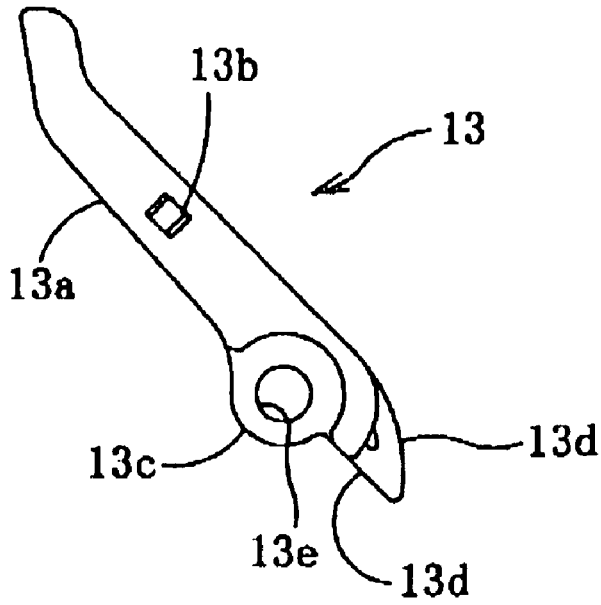
FIG. 14 is a right side view of a second lever.
Figure 15:
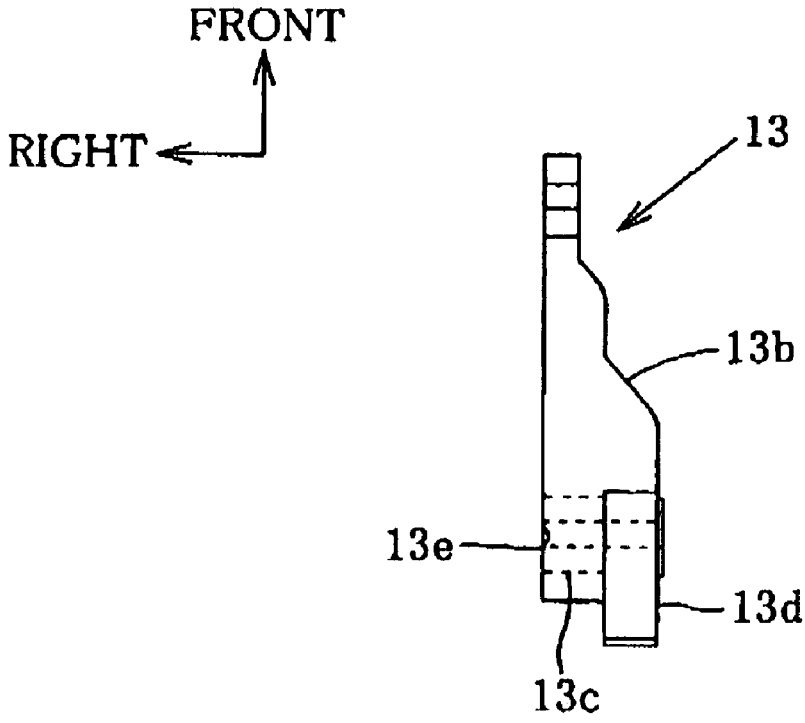
FIG. 15 is a plan view of the second lever.

The inclined portion 12*e* is formed so as to be inclined forwardly downward from the horizontal portion 12*d*. The cloth pressing portion 12*b* is formed into a sideways elongate oval shape and sized so as to be insertable into the aperture 17*b* of the body 17 of the presser foot 10 as shown in FIG. 13. The pressing portion 12*b* has a centrally formed oval needle insertion hole 12*f* through which the needle 5 is insertable.

Referring to FIGS. 3, 5, 6, 14 and 15, the second lever 13 is made of a synthetic resin and includes an abutment portion 13*a* normally in abutment with a needle clamp arm 8*a* of the needle clamp 8 moved upward and downward with the needlebar 6, a guide portion 13*b*, a support portion 13*c* pivotally mounted on the upper end of the first lever member 13 and a limiting portion 13*d*. The support portion 13*c* has therein a pin hole 13*e* extending therethrough in the longitudinal direction. A support pin 22 is fitted in the pin hole 13*e*. The support pin 22 has a left end secured to the connecting hole 11*e* formed in the upper end of the first lever member 11.

The second lever 13 is mounted on the upper end of the first lever member 11 via the support pin 22 so as to be pivotable vertically. Furthermore, the left end of the support portion 13*c* is in abutment with the right side of the upper end of the first lever member 11. The right end of the support portion 13*c* is in abutment with a flange formed on the head of the support pin 22. Accordingly, the second lever member 13 is held so as to be immovable in the longitudinal direction relative to the first lever member 11.

The support portion 13*c* is provided with a torsion coil spring 23 (serving as a second biasing member) imparting a smaller pivotal biasing force than the torsion coil spring 21. The torsion coil spring 23 has one of two ends engaging the connecting hole 11*c* of the first lever member 11 and the other end engaging the guide portion 13*b* of the second lever member 13. The pivotal biasing force of the torsion coil spring 23 biases the second lever member 13 in such a direction that the abutment 13*a* is caused to abut against the needle clamp arm 8*a*. The limiting portion 13*d* is formed so as to protrude rearward from the rear end of the support portion 13*c*.

Figure 16:
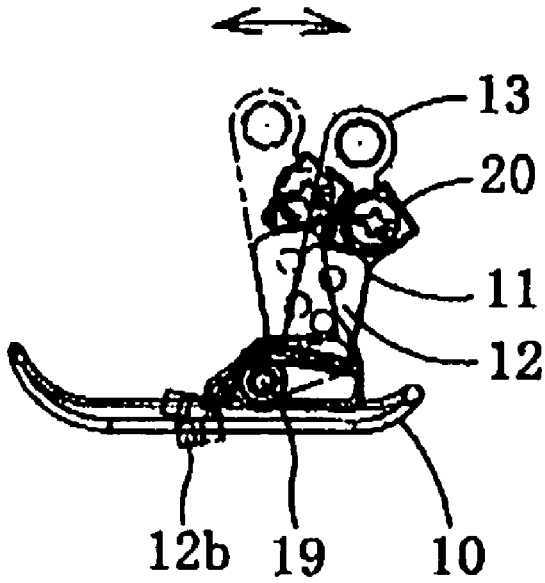
FIG. 16 is a right side view of the first lever, showing a swinging range thereof.

The following describes the first limiting mechanism 15 which limits a swinging range of the first lever member 11 in the longitudinal direction. The first limiting mechanism 15 includes a front end 11*f* which is a lower end of the first lever member 11, a rear end 11*g* and an inclined portion 17*e* and a protrusion portion 17*g* formed in an upper face of the body 17 between the first and second connecting protrusions 18*b* and 18*c*, as shown in FIG. 11. The first lever member 11 has a swinging range from a forward swing limit position as shown by two-dot chain line in FIG. 16 to a rearward swing limit position as shown by solid line in FIG. 16. The front end 11*f* of the lower end of the first lever member 11 abuts against the inclined portion 17*e* at the forward swing limit position as shown by two-dot chain line. The rear end 11*g* of the lower end of the first lever member 11 abuts against the protrusion 17*g* at the rearward swing limit position as shown by solid line.

Figure 17:
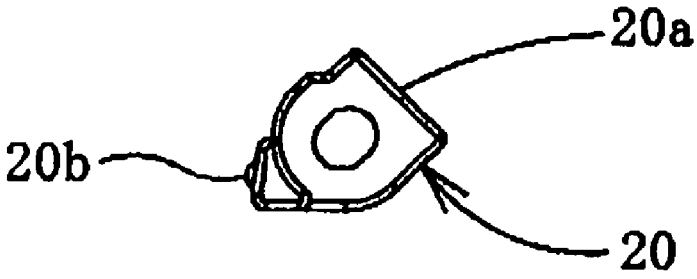
FIG. 17 is a right side view of a stopper member.
Figure 18:
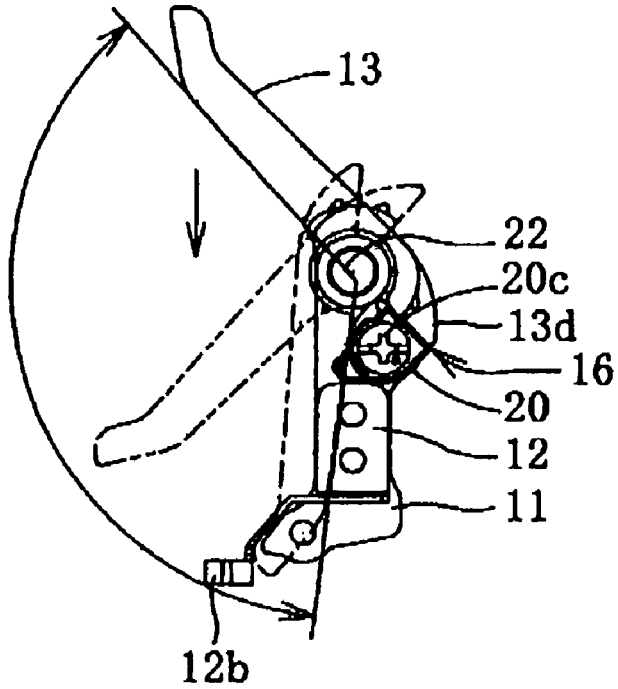
FIG. 18 is a right side view of the second lever, showing a swinging range thereof.

The second limiting mechanism 16 will now be described. The second limiting mechanism 16 limits a swinging range of the second lever member 13 in the vertical direction. The second limiting mechanism 16 is provided near the center of pivotal movement of the second lever member 13 and includes a limiting portion 13*d* for the second lever member 13 and the stopper member 20 as shown in FIG. 18. The stopper 20 includes an abutment surface 20*a* which abuts against the limiting portion 13*d* of the second lever member 13 and is formed so as to be inclined obliquely downwardly rightward as shown in FIG. 17. Furthermore, when second lever member 13 is swung downward, another front abutment surface 20*b* of the stopper member 20 abuts against the second lever member 13, as will be described later.

The second lever member 13 assumes a position as shown by two-dot chain line in FIG. 18 when the torsion coil spring 23 is in an unloaded condition. The swinging range of the second lever member 13 is from an upper limit swing position at which the limiting portion 13*d* abuts against the abutment surface 20*a* and which is shown by solid line in FIG. 18 to a lower limit swing position at which the second lever member 13 abuts against the abutment surface 20*b* and which is shown by chain line in FIG. 18. Since the second limiting mechanism 16 comprising the limiting portion 13*d* and the stopper member 20 is provided near the center of pivotal movement of the second lever member 13, a speed at which the limiting portion 13*d* abuts against the abutment surface 20*a* is decreased and accordingly, resultant shock is reduced and a produced collision noise is rendered smaller.

Figure 19:
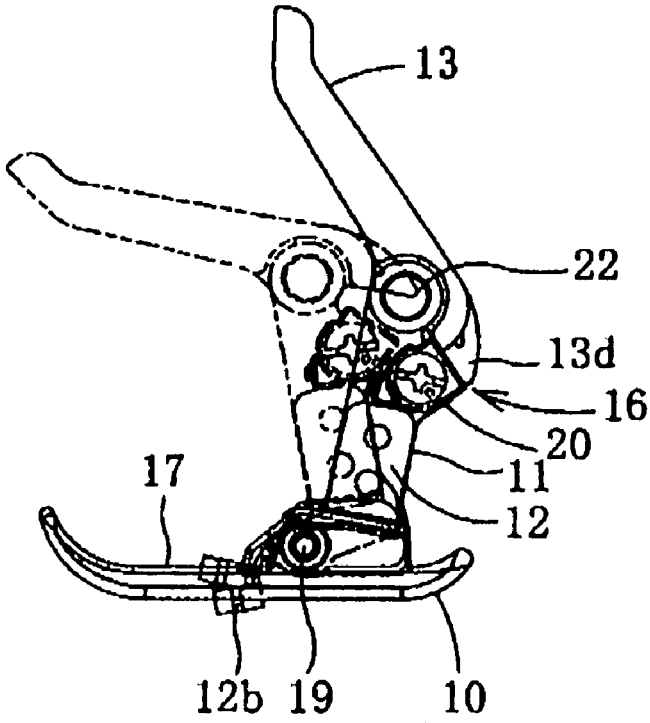
FIG. 19 is a right side view of the first and second levers, showing swinging states of the levers.

Furthermore, when the pivotal movement biasing force of the torsion coil spring 23 is set so as to be smaller than the pivotal movement biasing force of torsion coil spring 21, the first lever member 11 starts swinging after the swing of the second lever member 13 has been limited. More specifically, as shown in FIG. 19, the first lever member 11, subjected to the biasing force of the torsion coil spring 21, assumes the swing lower limit position as shown by two-dot chain line. On the other hand, when the torsion coil spring 23 is in an unloaded condition, the second lever member 13 assumes the position as shown by two-dot chain line in FIG. 18. Even when the second lever member 13 starts swinging upward against the biasing force of the second lever member 13, the first lever member 11 is locked at the swing forward limit position by the biasing force of the torsion coil spring 21 without swinging. Thereafter, when the limiting portion 13*d* of the second lever member 13 reaches the swing upper limit position where the limiting portion 13*d* abuts against the abutment surface 20*a*, the first and second lever members 11 and 13 swing in a unified manner against the torsion coil springs 21 and 23, whereupon both lever members assume respective positions as shown by solid line in FIG. 19.

Figure 20:
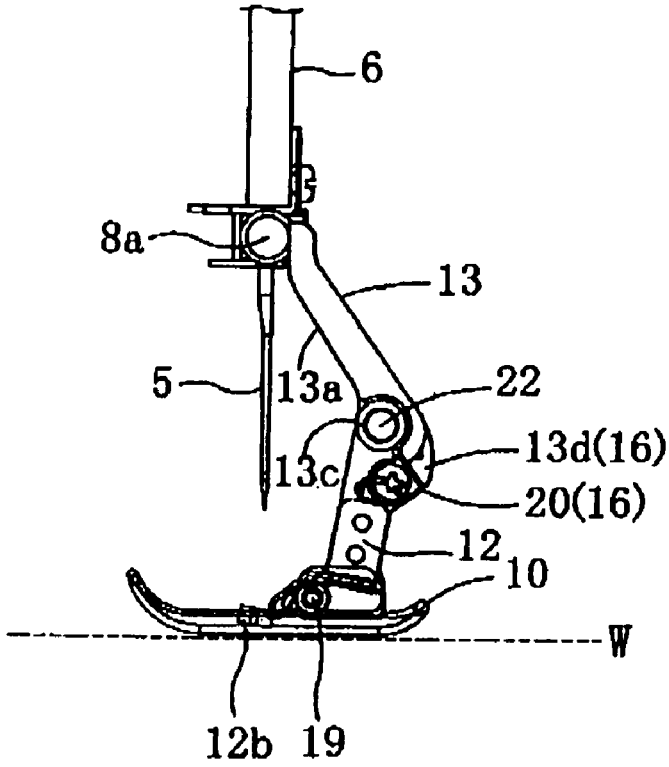
FIG. 20 is a right side view of the first and second levers under the condition where a needlebar is located at a highest position.
Figure 21:
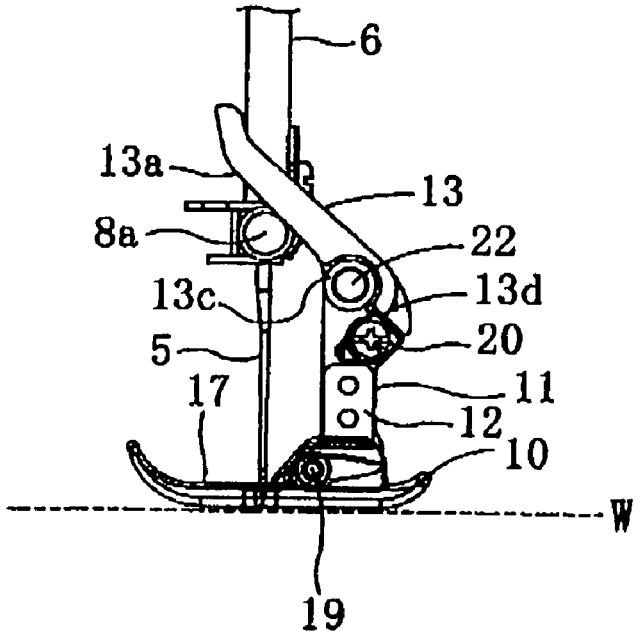
FIG. 21 is a right side view of the first and second levers, showing swinging states of the levers when the needle is moved downward.

The operation of the presser device 9 of the sewing machine 1 will now be described. When the needlebar 6 is located at the uppermost position, the second lever member 13 assumes swing upper limit position while the distal end of the abutment portion 13*a* is in abutment with the needle clamp 8*a*, and, furthermore, the first lever member 11 assumes a rearward swung position (a position in front of the swing rear limit position) as shown in FIG. 20. In this case, the cloth pressing portion 12*b* is located at the raised position (cloth presser opening position) which is located higher than the cloth pressing position. When the needlebar 6 is gradually moved downward, the first and second lever members 11 and 13 are swung counterclockwise following the downward movement of the needle clamp 8 while the middle portion of the abutment portion 13*a* of the second lever member 13 is in abutment with the needle clamp arm ea from above, as shown in FIG. 21. The cloth pressing portion 12*b* is switched from the cloth presser opening position to the cloth pressing position by the swing of the first lever member 11.

Figure 22:
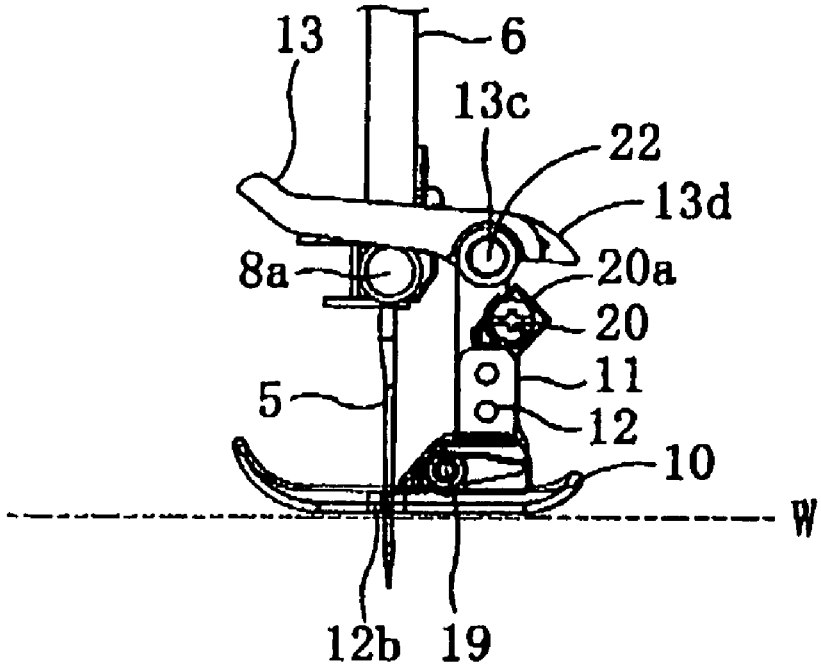
FIG. 22 is a right side view of the first and second levers, showing swinging states of the levers when the needle has passed through a needle through hole.
Figure 23:
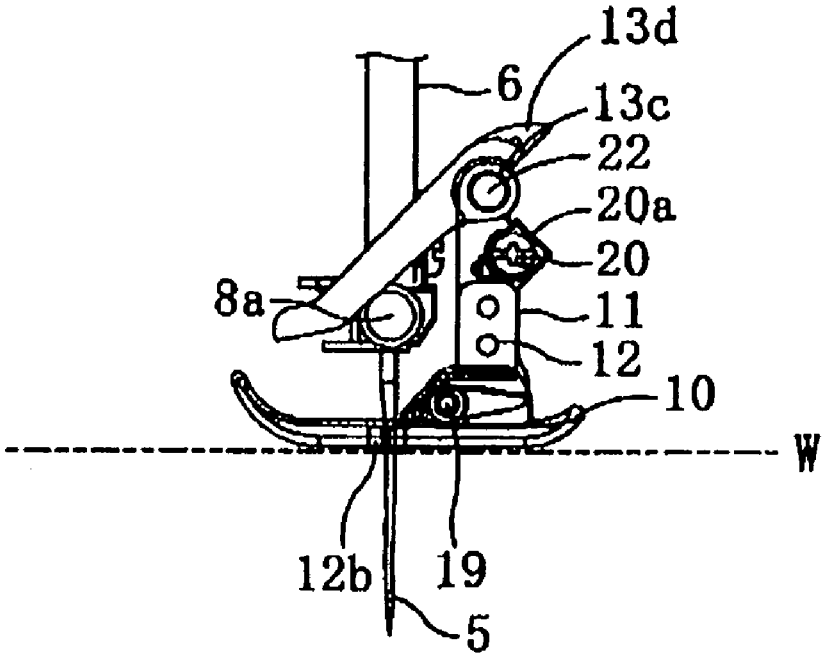
FIG. 23 is a right side view of the first and second levers, showing swinging states of the levers when the needle has been moved to a lowermost position.

Upon further downward movement of the needlebar 6, the cloth pressing portion 12*b* presses the workpiece cloth W near the needle location of the needle 5, and only the second lever member 13 is swung while the middle portion of the abutment portion 13*a* of the second lever member 13 is in abutment with the needle clamp arm 8*a*, as shown in FIG. 22. Furthermore, as shown in FIG. 23, when the needlebar 6 is moved to the lowermost position, the front end of the abutment portion 13*a* of the second lever member 13 assumes a downwardly inclined posture while being in abutment with the needle clamp arm 8*a*.

Figure 24:
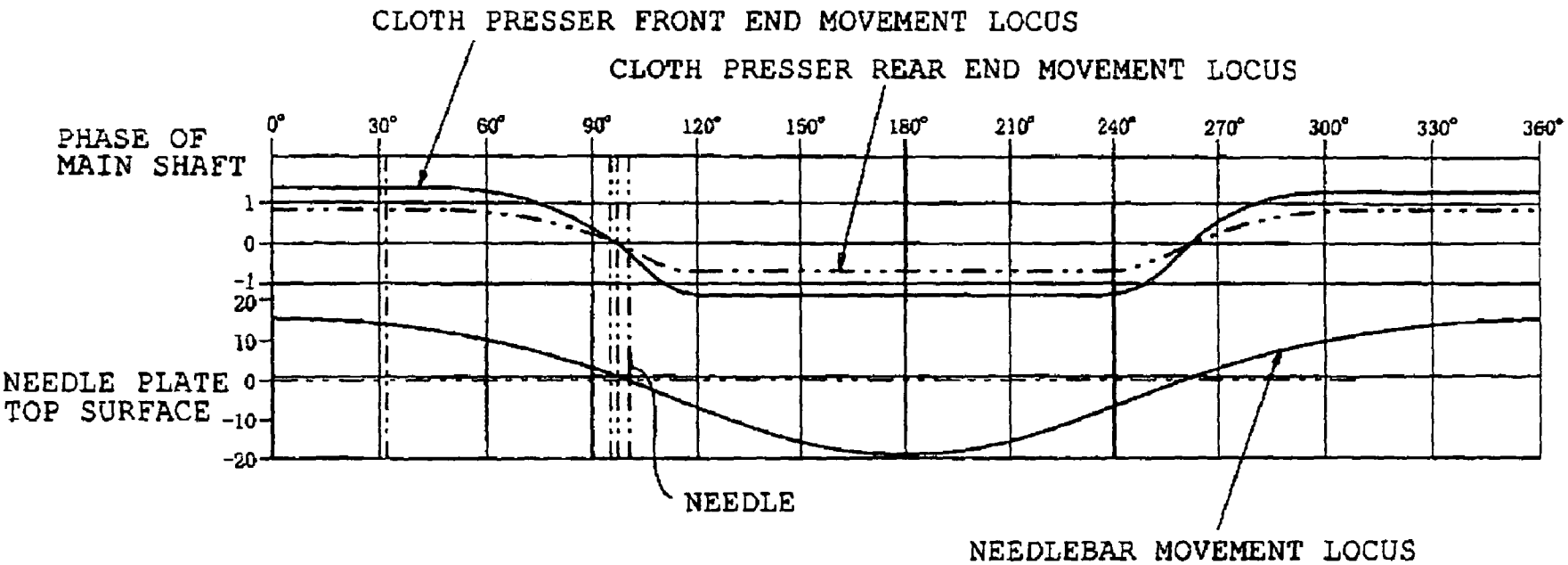
FIG. 24 is a timing chart showing operation of the cloth pressing portion and the needlebar.

The following briefly describes an operation timing chart of the cloth pressing portion 12*b* of the cloth presser member 12 during operation of the needlebar 6. FIG. 24 illustrates movement loci of the front and rear ends of the cloth pressing portion 12*b* of the cloth pressing member 13 and a movement locus of the needlebar in response to a rotational phase of the main shaft.

Firstly, the following describes a timing of movement of the cloth pressing member 12 from the open position to the cloth pressing position. The rotational phase of the main shaft is 0° when the needlebar 6 assumes the uppermost position. As shown in FIG. 24, the cloth pressing member 12*b* presses the workpiece cloth W when the needlebar 6 is moved downward so that the front and rear ends of the cloth pressing portion 12*b* are moved downward to the cloth pressing position with swing of the first lever member 11 and when the rotational phase of the main shaft is about 95°. When the rotational phase of the main shaft is about 100°, the distal end of the needle 5 is moved down to the upper surface of the needle plate such that the needle 5 is inserted through the through hole 12*f* of the cloth pressing portion 12*b* and further through the workpiece cloth W. Thereafter, the needle 5 is moved upward from the lowermost position. When the rotational phase of the main shaft is about 260°, the distal end of the needle 5 is moved to the upper surface of the needle plate. When the rotational phase of the main shaft is about 265°, the cloth pressing member 12 is moved upward from the cloth pressing position in retard of the needle 5.

Figure 25:
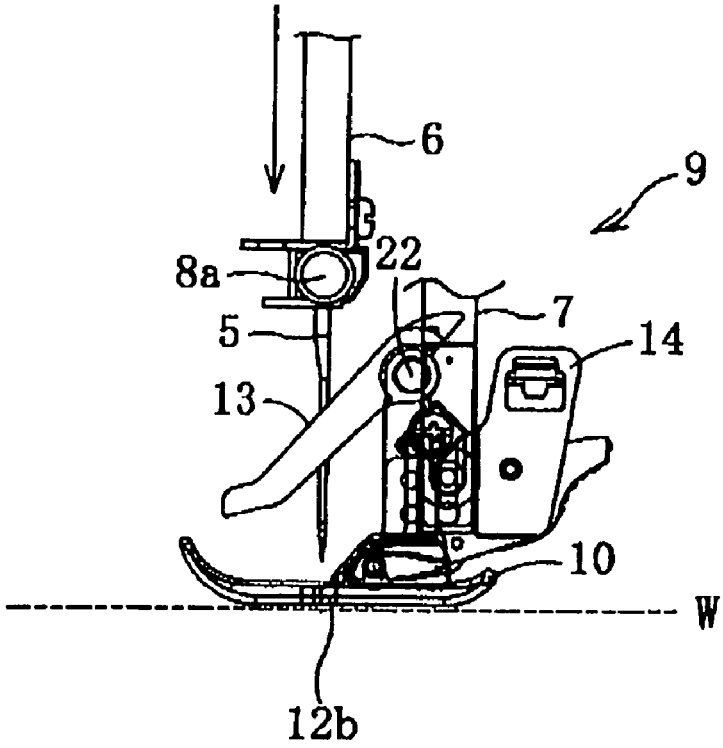
FIG. 25 is a side view of the second lever which has erroneously been attached, showing the condition where the presser foot assembly is located at a cloth pressing position.
Figure 26:
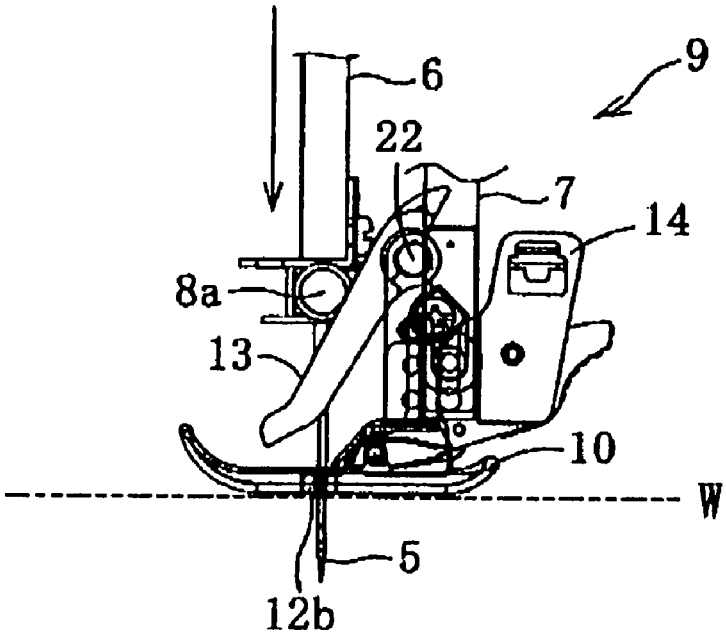
FIG. 26 is a side view of the second lever which has erroneously been attached, showing the condition where the needlebar has been moved downward.
Figure 27:
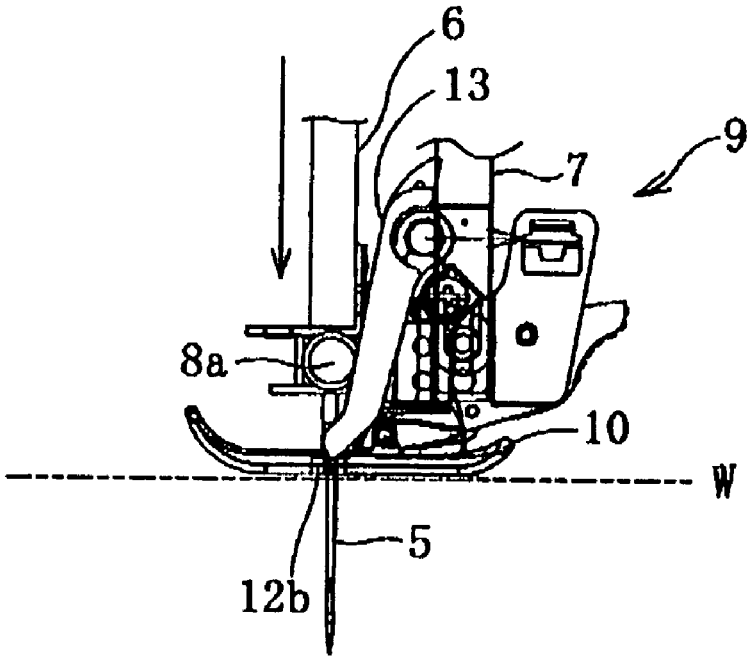
FIG. 27 is a side view of the second lever which has erroneously been attached, showing the condition where the needle has been moved to the lowermost position.

Next, the following describes the operation of the first and second lever members 11 and 13 in the case where the second lever member 13 is not in abutment with the needle clamp arm 8*a*, namely, where the needlebar 6 is moved downward while the second lever member 13 is located lower than the needle clamp arm 8*a* (erroneously attached state). As shown in FIG. 25, consider the case where the presser device 9 is erroneously attached to the presser bar 7 while the abutment portion 13*a* of the second lever member 13 is located lower than the needle clamp arm 8*a* without abutting against the needle clamp arm 8*a*. In this state, the presser bar 7 is moved downward so that the workpiece cloth W is pressed by the presser foot assembly 10. Thereafter, when the sewing machine 1 is actuated, the needlebar 6 is moved downward such that the needle clamp arm 8*a* is brought into contact with the upper surface of the second lever member 13 as shown in FIG. 26. When the needlebar 6 is further moved downward, the second lever member 13 is pressed by the needle clamp arm 8*a* as shown in FIG. 25. However, since the center of pivotal movement of the second lever member 13 is in the rear of a vertical line including the shaft center of the needlebar 6, the second lever member 13 can be retreated rearward behind the needle clamp arm 8*a* provided substantially on the shaft center of the needlebar 6. Accordingly, the second lever member 13 and the cloth pressing member 12 can be prevented from being damaged.

Figure 28:
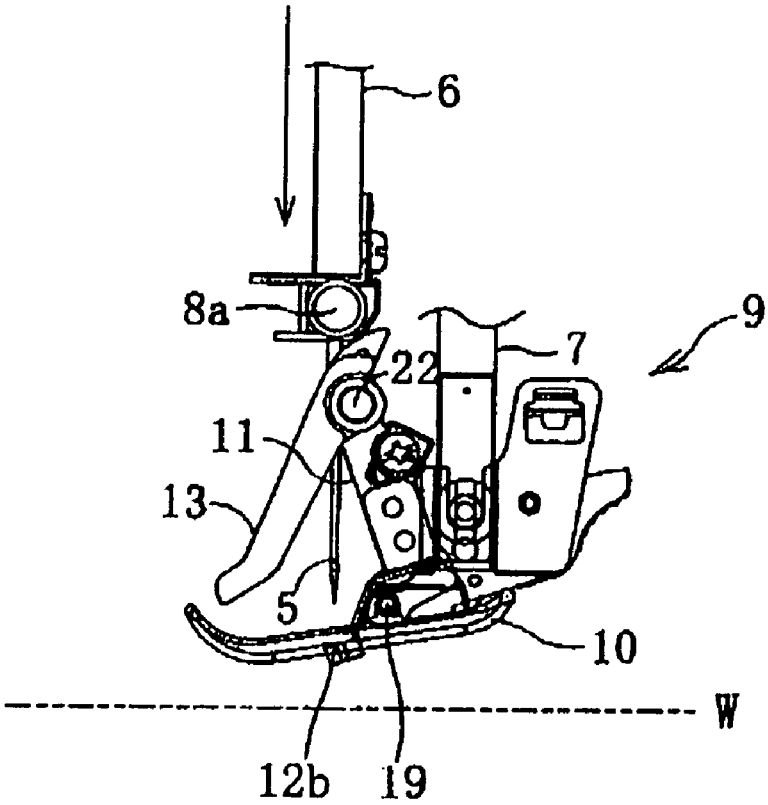
FIG. 28 is a side view of the second lever which has erroneously been attached, showing the presser foot is located at a cloth presser opening position.
Figure 29:
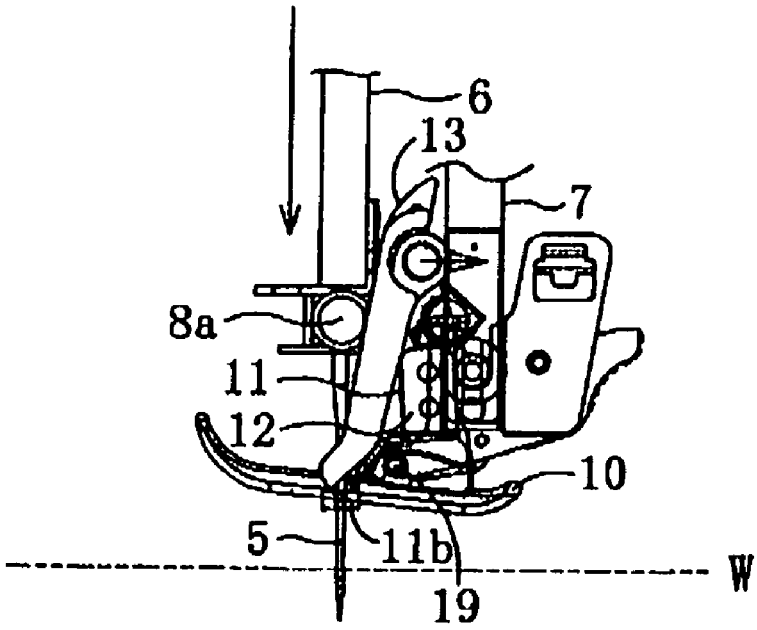
FIG. 29 is a side view of the second lever which has erroneously been attached, showing the condition where the needle clamp is in contact with the second lever.
Figure 30:
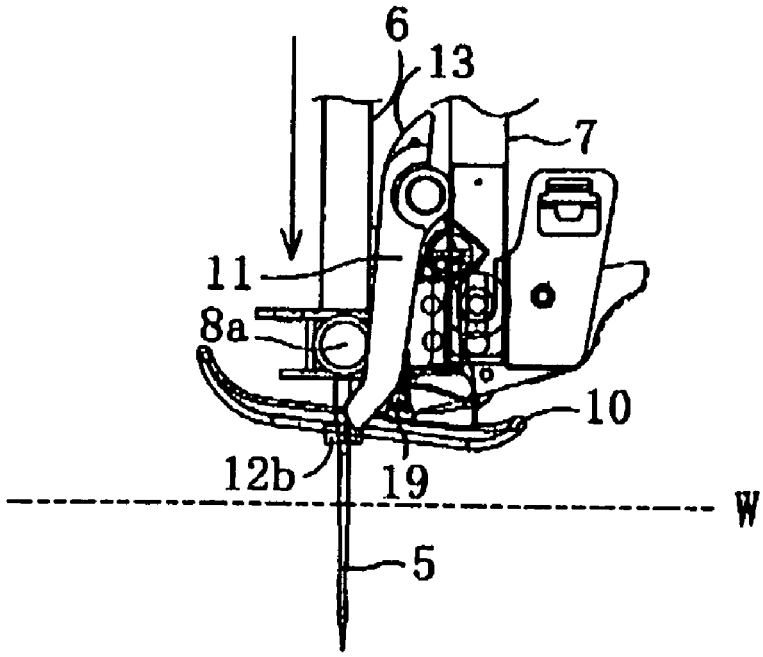
FIG. 30 is a side view of the second lever which has erroneously been attached, showing the condition where the needle has been moved to the lowermost position.

On the other hand, as shown in FIG. 28, when the needlebar 6 is moved downward while the presser device 9 assumes a position above the cloth pressing position, the needle clamp arm 8*a* is brought into contact with the upper surface of the second lever member 13. Thereafter, when the needlebar 6 is further moved downward, the second lever member 13 is swung downward as pressed by the needle clamp bar 8*a* and the presser foot assembly 10 is swung clockwise about the fixing pin 19 since the center of pivotal movement of the second lever member 13 is in the rear of the vertical line including the shaft center of the needlebar 6, as shown in FIGS. 29 and 30. Thus, the second lever member 13 can be retreated in the rear of the needle clamp arm 8*a* provided substantially on the shaft center of the needlebar 6 in cooperation of the downward swing of the second lever member 13 and the swing of the presser foot assembly 10 in the clockwise direction. Accordingly, the second lever member 13 and the cloth pressing member 12 can be prevented from being damaged.

As obvious from the foregoing, the second lever member 13 is swung following the downward movement of the needle clamp 9, and the cloth pressing portion 12*b* of the cloth pressing member 12 presses the workpiece cloth W near the needle location of the needle 5 by the swing of the first lever member 11 during the downward movement of the needle 5 in the presser device 9 of the sewing machine 1. Furthermore, when the needle 5 is moved upward, the second lever member 13 is swung following the upward movement of the needle clamp 8, and the cloth pressing portion 12*b* is switched from the cloth pressing position to the raised position by the swing of the first lever member 11. Accordingly, when the needle 5 has been moved downward, the workpiece cloth W can reliably be pressed. Since the second lever member 13 is normally in abutment with the needle clamp 8 which is moved upward and downward together with the needlebar 6, the production of collision noise by the second lever member 13 and the needle clamp 8 can be prevented.

The shock caused when the swing of the second lever member 13 is limited can be rendered smaller since the second limiting mechanism 16 limiting the swing of the second lever member 13 is provided near the center of pivotal movement of the second lever member 13. Consequently, the production of collision in the above case can be prevented.

When the needle clamp arm 8*a* is moved upward so that second lever member 13 is caused to pivot, the pivotal movement biasing force of the torsion coil spring 23 is set so as to be weaker than the pivotal movement biasing force of the torsion coil spring 21 so that the first lever member 11 is swung after the swing of the second lever member 13 has been limited by the second limiting mechanism 16. Consequently, the cloth pressing portion 11*b* can be switched between the cloth pressing position and the raised position in time for a needle location point of the needle 5 due to the vertical movement of the needlebar 6.

The second lever member 13 is pressed by the needle clamp arm 8*a* when the needlebar 6 is moved downward while the second lever member 13 is located lower than the needle clamp arm 8*a*. However, the center of pivotal movement of the second lever member 13 is in the rear of a vertical line including the shaft center of the needlebar 6. Accordingly, the second lever member 13 can be retreated rearward behind the needle clamp arm 8*a* provided substantially on the shaft center of the needlebar 6. Consequently, the second lever member 13 and the cloth pressing member 12 can be prevented from being damaged.

Figure 31:
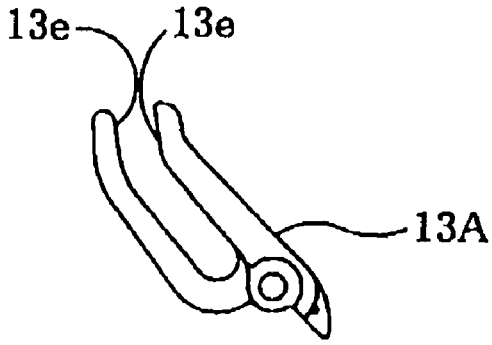
FIG. 31 is a side view of a modified form of the second lever.

Several modified forms of the foregoing embodiment will be described. The second lever member 13A may be formed into a bifurcated shape as shown in FIG. 31. Since the needle clamp arm 8*a* is moveably held by the abutment portions 13*e* in this case, the swinging operation of the second lever member 13 can reliably be followed by the vertical movement of the needle clamp arm 8*a* which is vertically moved with the needlebar 6.

Figure 32:
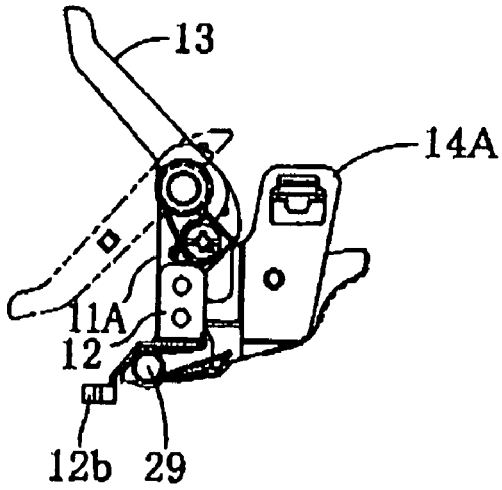
FIG. 32 is a side view of a modified form of the first lever provided on the presser holder.

The presser holder 14 and the presser foot assembly 10 may be formed integrally with each other although the presser holder 14 is detachably attached to the body 11 of the presser foot assembly 10 in the foregoing embodiment. Furthermore, the lower end of the first lever member 11 is inserted between the first and second connecting protrusions 18*b* and 18*c* and supported by the fixing pin 19 in the foregoing embodiment. However, the first lever member 11A may be supported on the presser holder 14A by a swaging pin 29 as shown in FIG. 32. In this case, since the presser foot assembly 10 is replaceably attached to the presser holder 14A, different types of presser foot assemblies 10 can suitably be used as the sewing situation demands. Furthermore, the first lever member 11A may be supported by a screw, instead of the swaging pin 29. In this case, when the first lever member 11B is detached from the presser holder 14, the presser holder 14 can be used as a normal presser holder.

Figure 33:
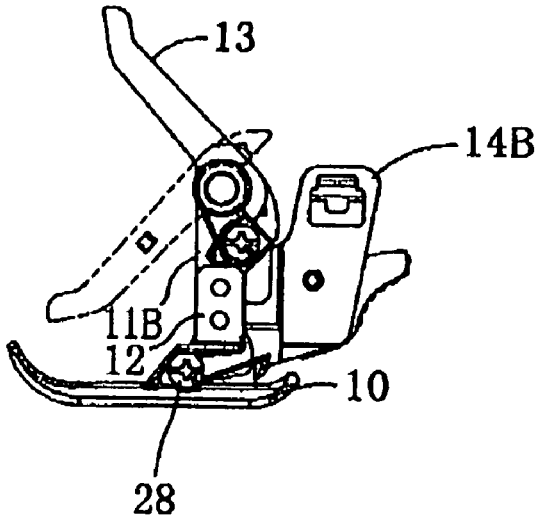
FIG. 33 is a side view of the modified form of the first lever detachably attached to the presser foot.

The first lever member 11B may detachably be attached to the presser foot assembly 10 by a screw 28 as shown in FIG. 33. In this case, when the first lever member 11B is detached from the presser foot assembly 10, the presser foot assembly 10 can be used in a normal pattern sewing mode. Furthermore, the cloth pressing member 12 may be formed integrally with the presser foot assembly 10 although the cloth pressing member 12 is mounted to the first lever member 11 by rivets in the foregoing embodiment. Furthermore, the abutment portion 13*a* may be constructed so as to abut against the needlebar 6 or another part of the needlebar assembly 24 although the abutment portion 13*a* of the second lever member 13 is constructed so as to normally abut against the needle clamp 8 in the foregoing embodiment.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A presser device for a sewing machine which includes a presser bar, a needle and a needle bar assembly, the presser device comprising:

a presser foot assembly which is connected to a lower end of the presser bar to press workpiece cloth to be sewn;

a first lever having a cloth pressing portion which is swingably mounted on the presser foot, the cloth pressing portion being swung so as to be switchable between a cloth pressing position where a part of the workpiece cloth located near a needle location of the needle is pressed by the cloth pressing portion when the needle is moved downward and a raised position to which the cloth pressing portion is raised from the cloth pressing position;

a second lever having a support portion where the second lever is pivotally supported on an upper part of the first lever and an abutment portion which is normally in abutment with the needlebar assembly moved up and down;

a first biasing member which biases the first lever so that the first lever is caused to pivot in such a direction that the cloth pressing portion becomes a cloth pressing position; and a second biasing member which biases the second lever so that the second lever is caused to pivot in such a direction that the abutment portion of the second lever abuts against the needlebar assembly.

2. The presser device according to claim 1, further comprising a limiting mechanism which is provided on the first and second levers to limit a swinging range of the second lever, wherein the first and second biasing members have respective biasing forces set so that when the second lever is caused to pivot with upward movement of the needlebar, the first lever is swung after the swinging range of the second lever has been limited by the limiting mechanism.

3. The presser device according to claim 1, wherein a distance from a center of swinging movement of the first lever to the needle location of the needle is set so as to be equal to or shorter than a predetermined distance.

4. The presser device according to claim 1, wherein the first lever is detachably attachable to the presser foot assembly.

5. The presser device according to claim 1, wherein the second lever has a center of pivoting which is located in the rear of a vertical line including a center of axle of the needlebar assembly.

6. The presser device according to claim 1, wherein the needlebar assembly includes a needlebar and a needle clamp which fixes the needle to the needlebar, wherein the abutment of the second lever is formed into a bifurcated shape with the needle clamp being interposed between bifurcated portions thereof.

7. A sewing machine comprising:

a presser bar;

a needle;

a needlebar assembly;

a presser foot assembly which is connected to a lower end of the presser bar to press workpiece cloth to be sewn;

a first lever having a cloth pressing portion which is swingably mounted on the presser foot assembly, the cloth pressing portion being swung so as to be switchable between a cloth pressing position where a part of the workpiece cloth located near the needle location of the needle is pressed by the cloth pressing portion when the needle is moved downward and a raised position to which the cloth pressing portion is raised from the cloth pressing position;

a second lever having a support portion where the second lever is pivotally supported on an upper part of the first lever and an abutment which is normally in abutment with the needlebar assembly moved up and down;

a first biasing member which biases the first lever so that the first lever is caused to pivot in such a direction that the cloth pressing portion becomes a cloth pressing position; and a second biasing member which biases the second lever so that the second lever is caused to pivot in such a direction that the abutment of the second lever is abutted against the needlebar assembly.

8. The sewing machine according to claim 7, further comprising a first lever limiting mechanism provided on the presser foot and the first lever for limiting a swinging range of the first lever.

9. The sewing machine according to claim 7, further comprising a second lever limiting mechanism provided on the first and second levers for limiting a swinging range of the second lever.

10. The sewing machine according to claim 9, wherein the second lever limiting mechanism is disposed near a center of pivoting of the second lever.

* * * * *